US007249758B2

(12) United States Patent
Shimizu

(10) Patent No.: US 7,249,758 B2
(45) Date of Patent: Jul. 31, 2007

(54) IMAGE FORMING APPARATUS WITH FINISHING UNIT

(75) Inventor: Kiichirou Shimizu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 250 days.

(21) Appl. No.: 11/012,252

(22) Filed: Dec. 16, 2004

(65) Prior Publication Data

US 2005/0151311 A1 Jul. 14, 2005

(30) Foreign Application Priority Data

Dec. 16, 2003 (JP) ..... 2003-417949

(51) Int. Cl.
*B65H 37/04* (2006.01)

(52) U.S. Cl. ..... 270/52.06; 270/58.02; 270/58.09; 270/58.08; 271/258.02

(58) Field of Classification Search ..... 270/52.06, 270/58.02, 58.09; 271/258.02
See application file for complete search history.

(56) References Cited

U.S. PATENT DOCUMENTS 5,322,274 A * 6/1994 Takahashi et al. ..... 271/258.01
2002/0109283 A1* 8/2002 Hasegawa et al. ..... 270/58.08

FOREIGN PATENT DOCUMENTS

JP 2000-191224 7/2000

* cited by examiner

*Primary Examiner*—Gene O. Crawford
*Assistant Examiner*—Leslie A. Nicholson, III
(74) *Attorney, Agent, or Firm*—Oblon, Spivak, McClelland, Maier & Neustadt, P.C.

(57) ABSTRACT

An image forming apparatus according to the present invention enables a user to remove the printed papers from the finisher without the image forming apparatus mistakenly judging that a paper jam has occurred; and has effects including a preventing the occurrence of malfunctions such as a jammed staples and the like, a wasting of resources and time for unnecessary re-printing, and increasing usability of the image forming apparatus by allowing a user in a hurry to remove printed copies without affecting the performance of the image forming apparatus.

4 Claims, 4 Drawing Sheets

IMAGE FORMING APPARATUS WITH FINISHING UNIT

CROSS-REFERENCE TO RELATED APPLICATIONS

The present document incorporates by reference the entire contents of Japanese priority document, 2003-417949 filed in Japan on Dec. 16, 2003.

BACKGROUND OF THE INVENTION

1) Field of the Invention

The present invention relates to an image forming apparatus. More particularly, the present invention relates to an image forming apparatus that eliminates unnecessary operations when papers are removed from a finisher prior to processing by the finisher.

2) Description of the Related Art

Some copiers, facsimile machines, printers, and the like are equipped with a finisher to perform post-printing processing, such as stapling and the like. Among these finishers, there are large-size finishers that perform post-printing processing of printed papers; for example, accumulating reams of printed papers in an internal intermediate tray unit until there are enough sheets for stapling, stapling the papers, and discharging the stapled papers to a main tray. There are also small-size finishers that leave a portion of a ream of paper at a processing position on the finisher, and then convey most of this portion to a tray outside the finisher where this portion is stapled and discharged.

Since, in the large-size finisher, the reams of stapled paper are discharged to the main tray from the edge opposite the stapled edge, it is easy for the edges of the reams of paper to become separated and cause a discharge jam. Japanese Patent Application Laid-Open No. 2000-191224 discloses a method to avoid a jamming of stapled reams of paper during discharge.

On the other hand, in the small-size finisher a portion of the ream of paper remains in the finisher, and then most of this remaining portion is conveyed to a tray outside the finisher for stapling and discharge; so few paper jams occur on the conveyance route. Since papers are discharged outside the finisher prior to stapling, there are many users who, in a hurry, mistakenly assume that stapled papers are being discharged, and accidentally remove the papers before stapling.

Conventional image forming apparatuses employ a processing procedure wherein the removal, prior to stapling, of papers discharged outside the finisher is judged to be an abnormal termination of a normal image forming operation; and the conventional image forming apparatus is configured to repeat the image forming operation.

SUMMARY OF THE INVENTION

It is an object of the present invention to eliminate repetition of processing.

An image forming apparatus according to an aspect of the present invention includes a finisher that performs at least one finisher processing on a ream of paper on which images have been formed; a conveying unit that consecutively conveys the papers on which images have been formed to the finisher; a stacking unit that consecutively stacks the papers that are consecutively conveyed by the conveying unit at a processing position where the finisher processing is performed, wherein the stacking unit stacks the papers in such a manner that a portion of the papers is exposed to an outside of the image forming apparatus; a discharging unit that makes the finisher perform the finisher processing on the ream of paper when a predetermined number of papers are stacked at the processing position in the stacking unit, and discharges the ream of paper on which finisher processing has been performed to a discharge tray; and a detecting unit that detects presence or absence of the paper at the processing position in the stacking unit. If an execution of the finisher processing is designated, there is no discharging operation of papers by the discharging unit, and if, prior to execution of the finishing processing, the detecting unit detects an absence of paper in the stacking unit, then an occurrence of a paper jam is not recognized and an image forming operation is continued.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus according to the present invention are explained below in reference to the accompanying drawings. Although the embodiments explained below have various technically favorable qualifications because the embodiments are the exemplary embodiments of the present invention, the scope of the present invention is not limited to the following illustrative embodiments unless a particular limitation of the present invention is described.

Figure 1:
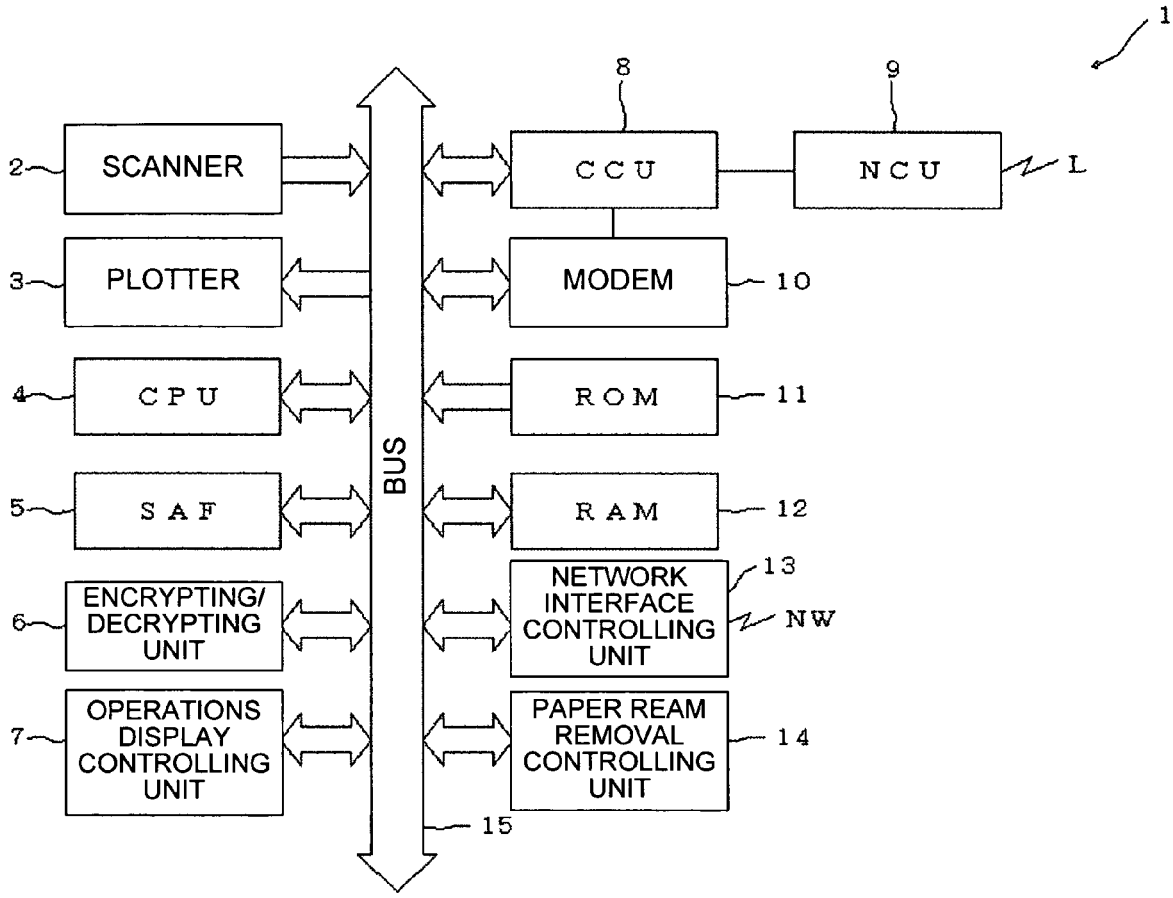
FIG. 1 is a block diagram of an image forming apparatus according to an embodiment of the present invention.

FIG. 1 is a block diagram of a configuration of an embodiment of an image forming apparatus 1 according to the present invention. As shown in FIG. 1, the image forming apparatus 1 includes a scanner 2, a plotter 3, a central processing unit (CPU) 4, a store-and-forward (SAF) memory 5, an encrypting/decrypting unit 6, an operations display controlling unit 7, a communications controlling unit (CCU) 8, a network controlling unit (NCU) 9, a modem 10, a read-only memory (ROM) 11, a random access memory (RAM) 12, a network interface controlling unit 13, and a paper ream removal controlling unit 14; which are each connected by a bus 15.

The ROM 11 stores computer programs for a basic processing, computer programs for a paper removal control processing, and various data and the like necessary for the execution of these computer programs. The RAM 12 is used as a work-storing memory of the CPU 4.

The CPU 4 uses the RAM 12 as the work-storing memory that is operated according to the computer programs that are stored in the ROM 11. The CPU 4 controls each unit of the image forming apparatus 1, and performs the basic processing and the paper removal control processing of the image forming apparatus 1.

The scanner 2 is an image scanner that employs charge-coupled devices (CCD). The scanner 2 is operated subordinate to the CPU 4, and scans documents to obtain document image data at a predetermined image resolution.

The plotter 3 uses, for example, an electro-photographic recording device and the like. The plotter 3 records and outputs on paper the image data received by a facsimile function of the image forming apparatus 1, or the images based on the document image data obtained by the scanner 2.

The encrypting/decrypting unit 6 is intended to maximize the efficiency of the accumulation of the image data in an image data memory (not shown), and to shorten transmission time. The encrypting/decrypting unit 6 encrypts the image data in accordance with a predetermined encryption method, or decrypts the encrypted image data in accordance with a predetermined decryption method.

An operations display unit (not shown) is connected to the operations display controlling unit 7. The operations display unit is equipped with various operation keys, such as a numerical keypad, a start key, and the like. The operations display unit is also equipped with a display (which is for example a liquid-crystal display). The operations display controlling unit 7 notifies the CPU 4 of an operation input through the operations display unit, and then displays data from the CPU 4 on the operations display unit. More particularly, the operations display unit is equipped with a mode selecting unit (mode selecting switch) that selects whether or not to recognize an occurrence of a paper jam when there are no more papers P (refer to FIG. 2), upon which images have been copied, at the processing position 23 (refer to FIG. 2).

The CCU 8 is connected to the NCU 9 and the modem 10. The NCU 9 is connected to the public switched telephone network or to leased lines via wiring L. The NCU 9 performs an automatic call-reception in response to an incoming call from the wiring L; or an automatic outgoing call to the wiring L. The modem 10 performs modulation of outgoing signals and demodulation of incoming signals. The communication controlling unit 8 converts facsimile control signals between the communication controlling unit 8 and an opposing facsimile device, and executes facsimile communication procedures.

The network interface controlling unit 13 connects a pre-selected network (NW) such as a local area network (LAN) to which information terminals, such as computers and the like, are connected. The network interface controlling unit 13 is subordinate to the CPU 4. The network interface controlling unit 13 receives various information from the information terminals via the network NW.

The paper ream removal controlling unit 14 controls, subordinate to the CPU 4, removal of unstapled reams of paper from a finisher 20 (refer to FIG. 2) that is provided in the image forming apparatus 1.

Figure 2:
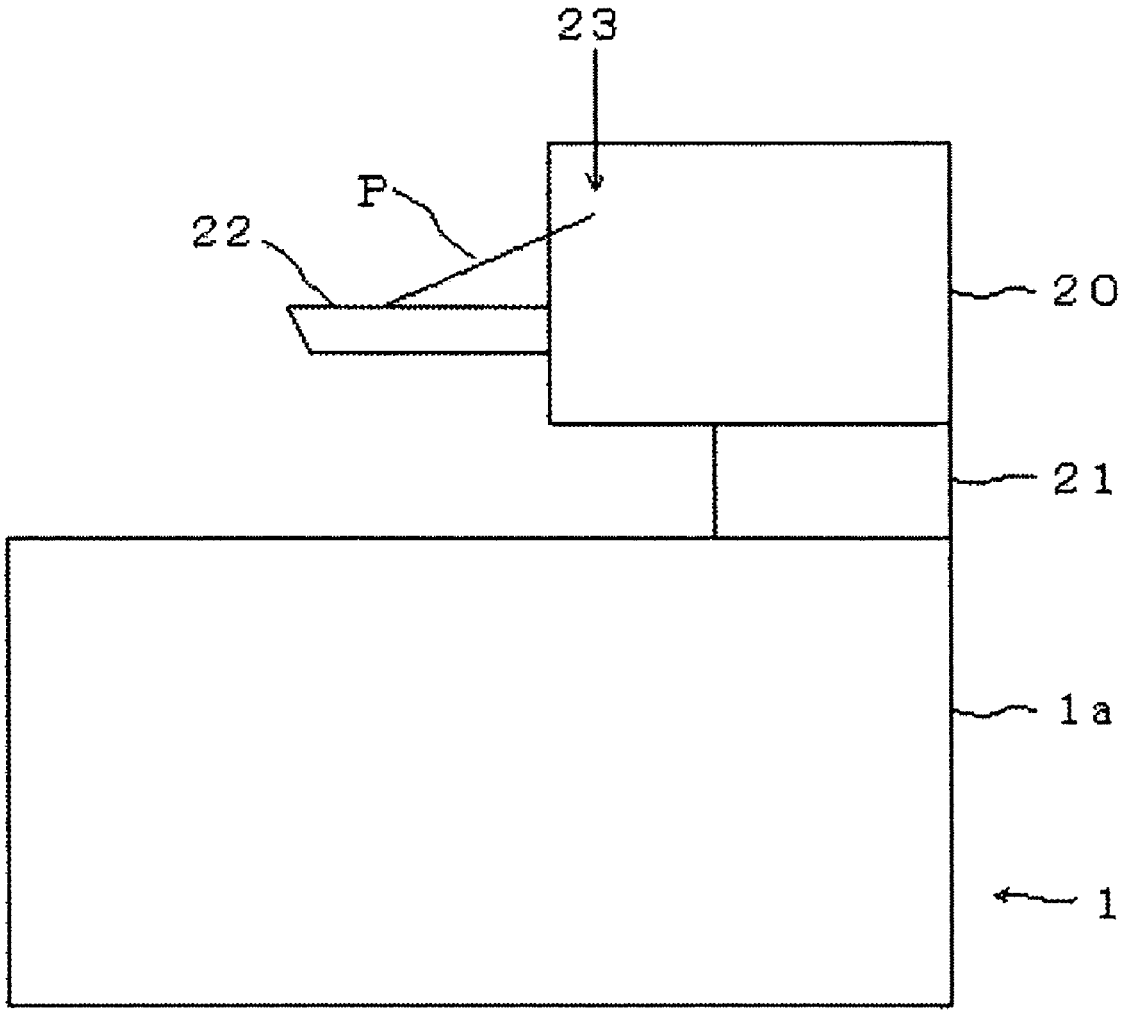
FIG. 2 is an external schematic of an image forming apparatus equipped with a finisher.

The image forming apparatus 1, as shown in FIG. 2, has the finisher 20 which is placed on an intermediate unit 21; and the intermediate unit 21 is placed on a main body 1*a* of the image forming apparatus 1. The finisher 20 has a discharge tray 22. The plotter 3 conveys papers P with images to a stapling structure (not shown) within the finisher 20. The stapling structure performs stapling at a stapling position 23 (processing position on the finisher) that is at the rear edge of the papers P. The leading edge of the paper P is positioned above the discharge tray 22 (hereinafter, the overlapping positions of the discharge tray 22 and the stapling position 23 is called "stapling tray position") where the paper P is then discharged.

The finisher 20 stacks the papers P at the stapling tray position when the consecutively printed papers P are conveyed from the image forming apparatus 1. The finisher staples the reams of papers P only when a series of papers P in a set is gathered, or when the number of papers P reaches an amount that can be stapled. After stapling, the papers P are discharged onto a discharge tray 22.

The following is an explanation of the operations of the present embodiment. The image forming apparatus 1 according to the present embodiment forms images in accordance with the settings for implementing the stapling. An appropriate processing is performed when an operator removes papers P when the papers P are being stacked on the staple tray position of the finisher 20.

Figure 4:
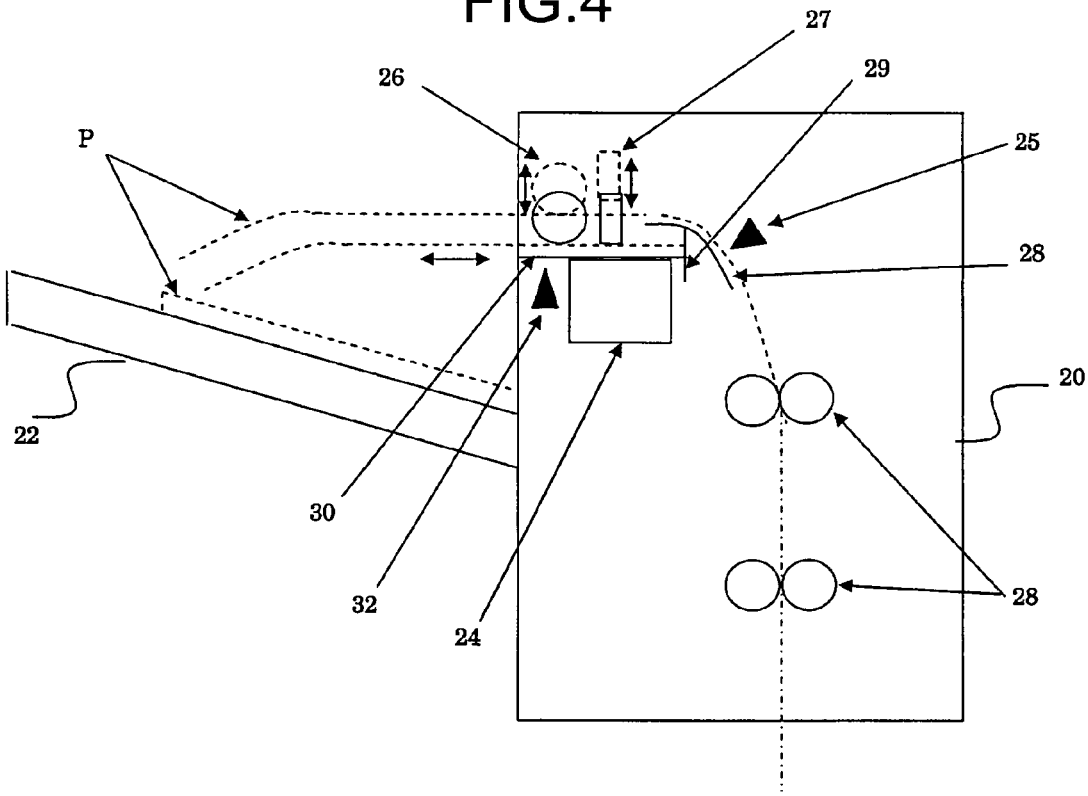
FIG. 4 is a detailed schematic of the finisher shown in FIG. 2.
Figure 5:
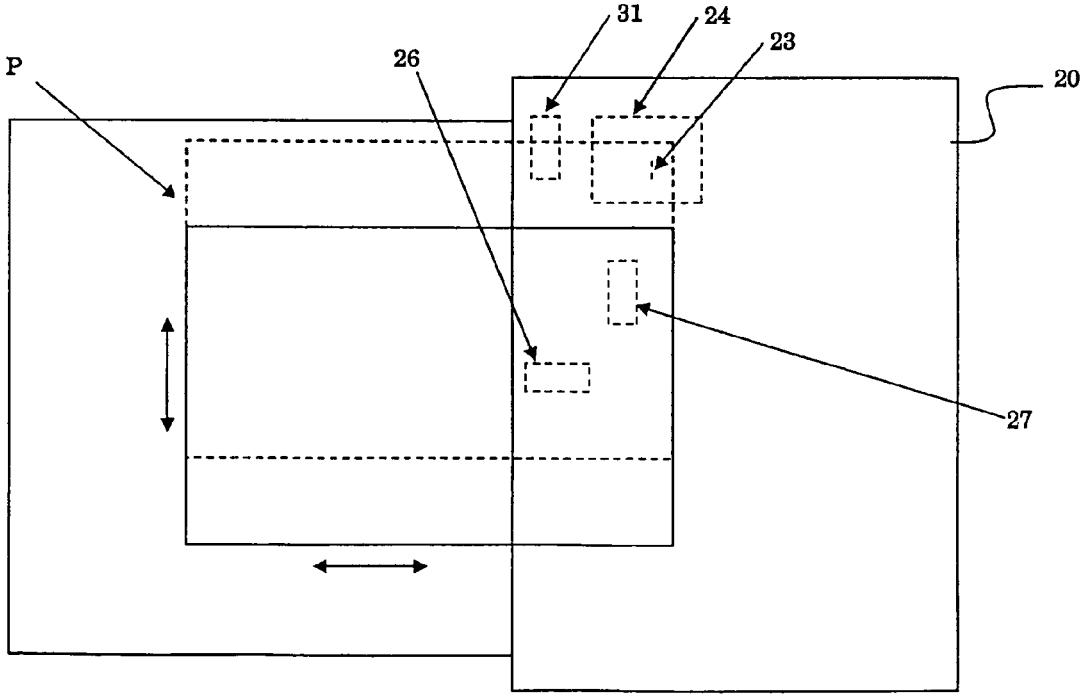
FIG. 5 is a top view of the finisher shown in FIG. 4.

FIG. 4 and FIG. 5 illustrate further details of the finisher 20. FIG. 4 is a detailed side view of the finisher 20; and FIG. 5 is a detailed top view of the finisher 20. The following describes stapling operations of the finisher 20.

If stapling is not required after image forming is performed on the papers P that are conveyed from a paper feeding tray, the papers P are discharged to a discharged paper unit (not shown) arranged in the upper portion of the image forming apparatus 1. If stapling is required, the papers P are conveyed through the intermediate unit 21, and further upwards by a pair of rollers 28 which are driven by a conveying motor (not shown). When a predetermined time elapses after a front-edge of a paper P passes an entrance sensor 25, a paper discharging roller 26 moves from the dotted-line position down to the full-line position and conveys the paper P to a position where the conveying of the paper P is timed to stop as the paper P passes by a guide 28. The paper P falls into a guide 30, and a reverse driving of the conveying motor conveys the paper P in the opposite direction to hit a stopper 29, where the front edge of the paper P is aligned. After the front edge of the papers P is aligned, a transverse roller 27 moves from a dotted-line position down to a full-line position, and the paper P is held by the paper discharging roller 26 and the transverse roller 27. Only the transverse roller 27 is holding the paper P after the paper discharging roller 26 moves from the full-line position up to the dotted-line position. A driving unit (not shown) drives the transverse roller 27 to move the paper P in an upward direction, according to FIG. 5, until the paper P hits a stopper (not shown). The leading edge of a ream of papers P is held by a paper holding unit 31, as shown in the upper part of FIG. 5, and the transverse roller 27 moves from the full-line position up to the dotted-line position, as shown in FIG. 4.

Since the operations subsequent to holding the papers P at a stapling tray position involve having a part of the papers P exposed outside of the finisher 20, it is possible for the operator to have access to the papers P, and the possibility arises that papers P can be removed during the subsequent operations.

After the first sheet of paper P is held at a stapling tray position, the finisher 20 waits until the second and subsequent sheets of paper P are conveyed and the above-mentioned operations are repeated. However, when the papers P are moved, upwards as in FIG. 5, by the transverse roller 27, the paper holding unit 31 must be moved upwards so as not to interfere with the alignment of the papers P that are at the stapling tray position. The finisher 20 counts the sheets of papers P that pass the entrance sensor 25; and either holds only a series of papers P to be stapled, or holds a maximum number of any sheets that can be stapled. Then, the papers P are stapled at the stapling position by a stapler 24, the paper discharging roller 26 moves from the dotted-line position down to the full-line position, the conveying motor (not shown) is activated, and the stapled ream of papers P is discharged to the discharge tray 22. The presence or absence of papers P at the stapling position or the completion of paper discharging is confirmed by an output of a discharged paper sensor 32.

Figure 3:
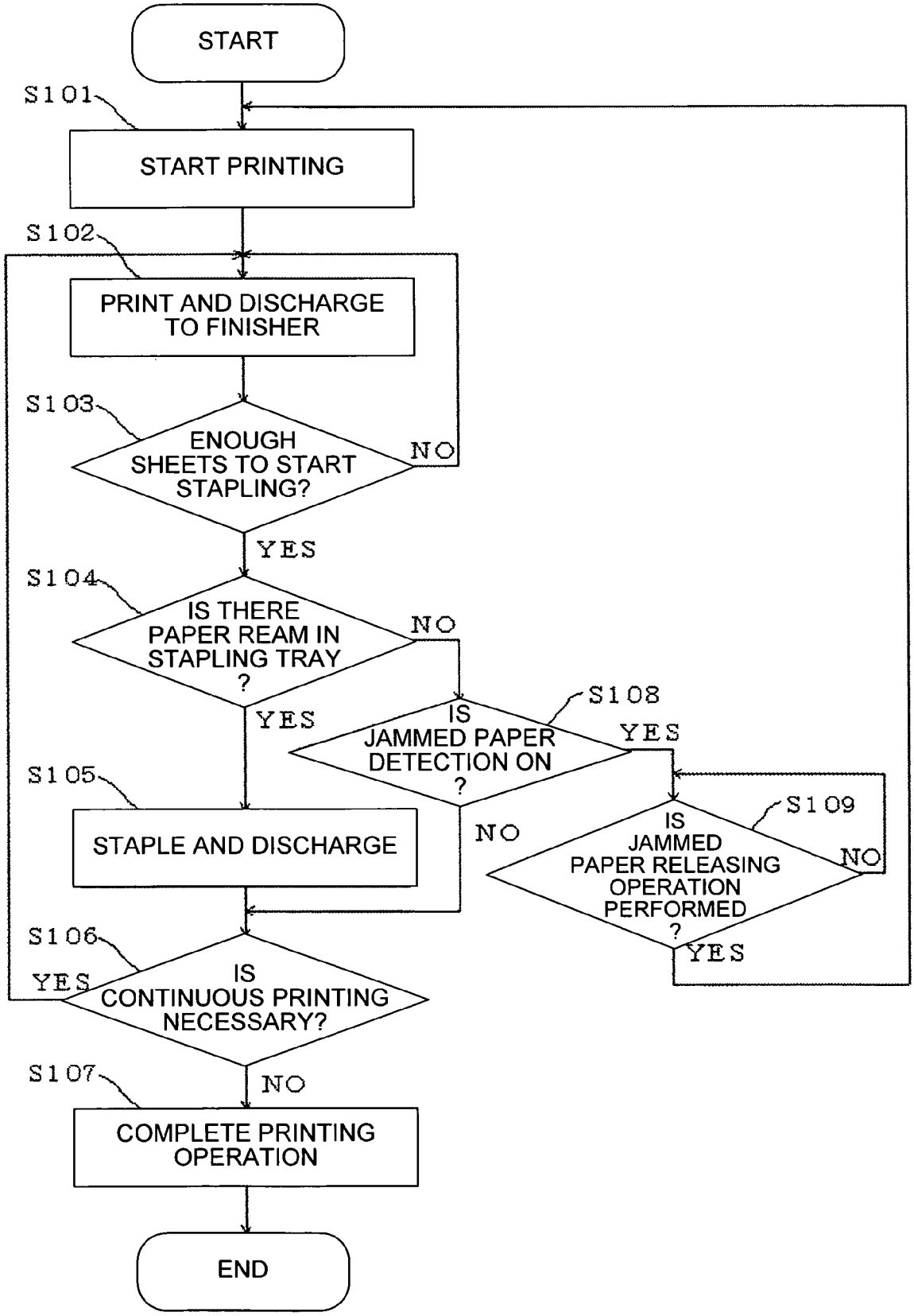
FIG. 3 is a flow chart of a process procedure performed by the image forming apparatus shown in FIG. 1.

In other words, when papers are removed from the stapling position 23, the image forming apparatus 1 turns a paper jam detection function "on" or "off" according to the setting on a mode selection switch on the operations display unit. If printing instructions are set to perform stapling; then, as shown in FIG. 3, printing starts at the plotter 3 (step S101). The papers P printed at the plotter 3 are consecutively discharged to the finisher 20 (step S102).

The finisher 20 positions the printed papers P at the stapling position 23 within the finisher 20. Further, the front-edges of the papers P are in a position (staple tray position) that is above the discharge tray 22. When the image forming apparatus 1 consecutively discharges the papers P to the finisher 20, printing is consecutively performed until the ream of papers P at the stapling tray position completes a series of papers P in a set, or the number of sheets that can be stapled is reached (steps S102 and S103).

In step S103, when papers P are stacked until the number of sheets in a set is reached or the number of sheets that can be stapled is reached, the paper ream removal controlling unit 14 checks whether there is a ream of papers P at the stapling tray position; in other words, whether the user has not removed a ream of papers P (step S104). When a ream of papers P exists, the finisher 20 staples the ream of papers P, and the stapled ream of papers P is discharged to a discharge tray 22 (step S105).

The image forming apparatus 1 then continues by checking whether there is more image data to print (step S106). When printing is continued, the image forming apparatus returns to step S102, and performs the processing above (steps S102 to S106).

If, in step S106, there is no more printing to be done, the image forming apparatus 1 ends printing operations, and processing is completed (step S107).

When, in step S104, there are no papers P at the stapling tray position, the paper ream removal controlling unit 14 checks whether the paper jam detection function on the mode selection switch is "on" (step S108). If the paper jam detection function is "on", the CPU 4 is notified of the occurrence of a paper jam; and the CPU 4 instructs the operations display controlling unit 7 to make the operations unit display a finisher discharge jam (paper jam). Printing operations (image forming operations) are stopped, and paper jam releasing operations, for example, confirming an opening or closing of a door of the finisher 20, is performed (step S109). Then, the image forming apparatus 1 returns to step S101, and starts printing operations from the beginning again (steps S101 to S109).

In step S108, if the mode selection switch is set to "off", or in other words, a setting that does not recognize the occurrence of a paper jam when the user removes all the papers P from the stapling tray position; the paper ream removal controlling unit 14 stops stapling operations that was planned for the removed papers P, and terminates processing related to stapling. The image forming apparatus 1 then checks whether there is image data to continue printing (step S106. If printing is continued, the image forming apparatus 1 returns to step S102, and repeats steps S102 to S106 above. If, in step S106, there is no printing to continue, the image forming apparatus 1 ends the printing operation, and processing is completed (step S107).

In the manner above, the image forming apparatus 1 according to the present embodiment conveys the papers P, on which images have been formed according to the image data, to the finisher 20 for processing by the finisher, such as consecutive stapling and the like. The finisher 20 positions the papers P at the stapling position 23, then staples the reams of papers P when the number of papers to be processed by the finisher is reached, and discharges the stapled papers P to the discharge tray 22. If there are no copied papers P at the stapling position 23 when the image forming apparatus 1 enters the stapling processing stage, the occurrence of a paper jam is recognized, and the image forming operations and the stapling operations are stopped. If there are no copied papers P at the stapling position 23 before stapling processing, the image forming apparatus 1 does not recognize the occurrence of a paper jam.

If the paper ream removal controlling unit 14 judges whether there is a ream of paper P at the stapling tray position during an image forming operation, and a ream of paper P cannot be detected at the stapling tray position at any time during a normal controlling operation for the image forming operation; then, instead of an indication that the operator has removed a ream of paper and stapling occurring even when there are few (or no) sheets of paper, it is possible to stop the stapling processing and to stop the recovery mechanism from performing a re-printing.

Accordingly, even if the user, who is in a hurry, removes the ream of copied papers P from the stapling position 23, the inconvenience of performing paper jam recovery measures is avoided, which improves the usability of the image forming apparatus 1.

Moreover, when the occurrence of a paper jam is not recognized, the image forming apparatus 1 according to the present embodiment prohibits the re-forming of the same image, that was formed on the discharged papers P, on separate papers P; and the discharge and stapling of copied papers P at the finisher 20.

Therefore, the wasting of resources and processing time, caused by the re-forming of the same images of the papers P that were accidentally removed by the user, is reduced; the consumption of resources is reduced; and the usability of the image forming apparatus 1 is increased.

Moreover, when a paper jam is not recognized, the image forming apparatus 1 according to the present embodiment terminates the planned stapling of the discharged papers P.

Accordingly, the jamming of staples, due to stapling on non-existent papers (blank stapling), and the like is controlled, the consumption of resources is reduced, the occurrence of malfunctions is prevented, and the usability of the image forming apparatus is increased.

When there are no more copied papers P at the stapling position 23, the image forming apparatus 1 according to the present embodiment performs the processing of recognizing or not recognizing the occurrence of a paper jam according to the selection on the mode selection switch of the operations displaying unit.

Accordingly, the user can select either to remove copied papers P before stapling if the user is in a hurry, or to allow the stapling process to end. Processing is performed according to the circumstances of the user, so usability of the image processing apparatus 1 is improved a step further.

According to the present invention, papers, upon which an image was formed based on image data, are conveyed to a finisher that performs processing, such as consecutive stapling and the like. The finisher consecutively conveys the papers and places the papers at a processing position on the finisher. When a predetermined number of papers to be processed by the finisher is reached, the ream of papers is processed and then discharged to a discharge tray. In a conventional image forming apparatus, when the processing by the finisher starts and there are no papers at the processing position on the finisher, the image forming apparatus judges that a paper jam has occurred and stops image forming and finisher operations. But in an image forming apparatus according to the present invention, if printed papers are removed by a user before processing by the finisher, the image forming apparatus can be set so as not to judge the absence of papers as a paper jam and continue a next image forming operation. The user can then avoid the inconvenience of recovery processing for a non-existent paper jam, and gains a benefit of increased usability of the image forming apparatus.

If the absence of copied papers at the processing position on the finisher is not judged to be a paper jam, the image forming apparatus prohibits a re-printing of the same image on separate papers, the discharging of the paper to the finisher, and the processing by the finisher. The present invention has the effects of reducing the waste of resources and processing time caused by the re-printing of the same image due to a user accidentally removing a ream of paper, and increasing usability of the image forming apparatus by eliminating unnecessary processing.

If the absence of papers at the processing position on the finisher is not recognized as a paper jam, the image forming apparatus stops the planned processing by the finisher by means of the present invention. This stopping of processing has the effects of preventing malfunctions, such as a jamming of staples due to blank stapling and the like, reducing the consumption of resources, which increases the usability of the image forming apparatus.

If there are no papers at the processing position on the finisher, the image forming apparatus processes, by means of the present invention, a recognition or a non-recognition of a paper jam in accordance with a selection, by the user, on a mode selection unit. The present invention has an effect that if the user is in a hurry, the mode selecting unit allows the user to select whether to permit the removal of a copied paper before processing by the finisher is completed, or to wait until after the processing by the finisher is completed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a finisher configured to perform at least one finisher processing on a ream of paper on which images have been formed;

a conveying unit configured to convey the papers on which images have been formed to the finisher;

a stacking unit configured to stack the papers that are consecutively conveyed by the conveying unit at a processing position where the finisher processing is performed, wherein the stacking unit is configured to stack the papers in such a manner that a portion of the papers is exposed to an outside of the image forming apparatus;

a discharging unit configured to cause the finisher to perform the finisher processing on the ream of paper when a predetermined number of papers have been stacked at the processing position in the stacking unit, and to discharge the ream of paper on which finisher processing has been performed to a discharge tray; and a detecting unit configured to detect a presence or absence of paper at the processing position in the stacking unit, wherein (1) if an execution of the finisher processing is designated, (2) there is no discharging operation of papers by the discharging unit, and (3) if, prior to execution of the finisher processing, the detecting unit detects an absence of paper in the stacking unit, then the image forming apparatus does not recognize that a paper jam has occurred and an image forming operation of the image forming apparatus is continued.

2. The image forming apparatus according to claim 1, wherein when the image forming apparatus does not recognize that the paper jam has occurred, the image forming apparatus prohibits reformation of an image that has been already formed.

3. The image forming apparatus according to claim 1, wherein when the image forming apparatus does not recognize that the paper jam has occurred, the finisher does not execute the finisher processing on the papers stacked in the stacking unit.

4. The image forming apparatus according to claim 1, further comprising:

a mode selection unit, wherein when paper is absent in the stacking unit, the image-forming apparatus recognizes the absence of paper as a paper jam or not, depending on a setting set by the mode selection unit.

* * * * *